US009860626B2

(12) United States Patent
Ergezer et al.

(10) Patent No.: US 9,860,626 B2
(45) Date of Patent: Jan. 2, 2018

(54) ON/OFF HEAD DETECTION OF PERSONAL ACOUSTIC DEVICE

(71) Applicant: Bose Corporation, Framingham, MA (US)

(72) Inventors: Mehmet Ergezer, Newton, MA (US); Joseph H. Cattell, Somerville, MA (US); Marko Orescanin, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 15 days.

(21) Appl. No.: 15/157,807

(22) Filed: May 18, 2016

(65) Prior Publication Data

US 2017/0339483 A1 Nov. 23, 2017

(51) Int. Cl.
*H04R 1/10* (2006.01)

(52) U.S. Cl.
CPC ..... *H04R 1/1041* (2013.01); *H04R 2460/01* (2013.01)

(58) Field of Classification Search
CPC ..... H04R 1/1041; H04R 2460/01
See application file for complete search history.

(56) References Cited

U.S. PATENT DOCUMENTS

| | | | |
|---|---|---|---|
| 4,955,729 | A | 9/1990 | Marx |
| 5,144,678 | A | 9/1992 | Lenz |
| 5,471,538 | A | 11/1995 | Sasaki et al. |
| 5,577,511 | A | 11/1996 | Killion |
| 5,708,725 | A | 1/1998 | Ito |
| 6,118,878 | A | 9/2000 | Jones |
| 6,163,610 | A | 12/2000 | Bartlett et al. |
| 6,532,294 | B1 | 3/2003 | Rudell |
| 6,542,436 | B1 | 4/2003 | Myllyla |
| 6,567,524 | B1 | 5/2003 | Svean et al. |

(Continued)

FOREIGN PATENT DOCUMENTS

| | | |
|---|---|---|
| DE | 102007013719 | 9/2008 |
| EP | 0363056 | 4/1990 |

(Continued)

OTHER PUBLICATIONS

Examination Report in European Patent Application No. 09719786.7, dated Mar. 15, 2011; 6 pages.

(Continued)

*Primary Examiner* — Ping Lee
(74) *Attorney, Agent, or Firm* — Schmeiser, Olsen & Watts LLP; William G. Guerin

(57) ABSTRACT

A method of controlling a personal acoustic device includes performing a first analysis of one or more of an inner signal output by an inner microphone and an outer signal output by an outer microphone disposed on the personal acoustic device to determine if a buffet event has occurred. A second analysis is performed on or both of the inner and outer signals to determine if a voice event of a user occurred. If a buffet event is determined to have occurred and a voice event is determined not to have occurred, a third analysis is performed on the inner and outer signals to determine an operating state of the personal acoustic device. If a change in the operating state is determined, an operation of the personal acoustic device may be initiated such as changing a power state, an ANR state or an audio output state of the device.

26 Claims, 3 Drawing Sheets

(56) References Cited

U.S. PATENT DOCUMENTS

| | | | |
|---|---|---|---|
| 6,639,987 | B2 | 10/2003 | McIntosh |
| 6,687,377 | B2 | 2/2004 | Voix et al. |
| 6,704,428 | B1 | 3/2004 | Wurtz |
| 6,763,116 | B2 | 7/2004 | Barthel et al. |
| 7,039,195 | B1 | 5/2006 | Svean et al. |
| 7,406,179 | B2 | 7/2008 | Ryan |
| 7,418,103 | B2 | 8/2008 | Sargaison |
| 7,433,481 | B2 | 10/2008 | Armstrong et al. |
| 7,450,730 | B2 | 11/2008 | Berg et al. |
| 7,522,739 | B2 | 4/2009 | Rass et al. |
| 7,639,827 | B2 | 12/2009 | Bachler |
| 7,783,057 | B2 | 8/2010 | Park |
| 7,925,029 | B2 | 4/2011 | Hollemans et al. |
| 8,238,567 | B2 | 8/2012 | Burge et al. |
| 8,243,946 | B2 | 8/2012 | Burge et al. |
| 8,699,719 | B2 | 4/2014 | Johnson, Jr. et al. |
| 2002/0076057 | A1 | 6/2002 | Levitsky et al. |
| 2003/0147544 | A1 | 8/2003 | Lichtblau |
| 2003/0161479 | A1 | 8/2003 | Yang et al. |
| 2004/0264706 | A1 | 12/2004 | Ray et al. |
| 2005/0226446 | A1 | 10/2005 | Luo et al. |
| 2006/0013079 | A1 | 1/2006 | Rekimoto |
| 2006/0029234 | A1 | 2/2006 | Sargaison |
| 2006/0045304 | A1 | 3/2006 | Lee et al. |
| 2006/0215847 | A1 | 9/2006 | Hollemans et al. |
| 2007/0076897 | A1 | 4/2007 | Philipp |
| 2007/0154049 | A1 | 7/2007 | Levitsky et al. |
| 2007/0160255 | A1 | 7/2007 | Cheng et al. |
| 2007/0274530 | A1 | 11/2007 | Buil et al. |
| 2007/0297618 | A1 | 12/2007 | Nurmi |
| 2007/0297634 | A1 | 12/2007 | Hansson |
| 2008/0080705 | A1 | 4/2008 | Gerhardt et al. |
| 2008/0107287 | A1 | 5/2008 | Beard |
| 2008/0192942 | A1 | 8/2008 | Yamkovoy et al. |
| 2008/0260176 | A1 | 10/2008 | Hollemans et al. |
| 2009/0154720 | A1 | 6/2009 | Oki |
| 2009/0268936 | A1 | 10/2009 | Goldberg et al. |
| 2010/0054518 | A1 | 3/2010 | Goldin |
| 2010/0128887 | A1 | 5/2010 | Lee et al. |
| 2010/0183183 | A1 | 7/2010 | Bae et al. |
| 2010/0189268 | A1 | 7/2010 | Haartsen et al. |
| 2010/0246845 | A1 | 9/2010 | Burge et al. |
| 2010/0246846 | A1 | 9/2010 | Burge et al. |
| 2010/0246847 | A1 | 9/2010 | Johnson et al. |
| 2011/0044464 | A1 | 2/2011 | Sapiejewski et al. |
| 2011/0144779 | A1 | 6/2011 | Janse et al. |
| 2011/0293129 | A1 | 12/2011 | Dillen et al. |
| 2012/0002822 | A1 | 1/2012 | Peissig et al. |
| 2014/0126736 | A1 | 5/2014 | Gauger, Jr. et al. |

FOREIGN PATENT DOCUMENTS

| | | |
|---|---|---|
| EP | 1059635 | 12/2000 |
| EP | 1465454 | 10/2004 |
| EP | 2425425 | 3/2012 |
| JP | 07-298383 | 11/1995 |
| WO | 2007049255 | 5/2007 |
| WO | 2007110807 | 10/2007 |
| WO | 2007141769 | 12/2007 |
| WO | 2008096125 | 8/2008 |
| WO | 2010117714 | 10/2010 |
| WO | 2015142630 | 9/2015 |

OTHER PUBLICATIONS

Intemational Preliminary Report on Patentability in International Patent Application No. PCT/US09/35826, dated Jun. 1, 2010; 19 pages.

International Search Report & Written Opinion in International Patent Application No. PCT/US10/29031, dated Aug. 10, 2010; 22 pages.

International Search Report & Written Opinion in International Patent Application No. PCT/US09/35826, dated Jun. 16, 2009; 12 pages.

Invitation to Pay Additional Fees in International Patent Application No. PCT/US10/29031, dated May 26, 2010; 7 pages.

Intemational Search Report and Written Opinion in counterpart International Application No. PCT/US2017/028077, dated Aug. 10, 2017; 12 pages.

ON/OFF HEAD DETECTION OF PERSONAL ACOUSTIC DEVICE

BACKGROUND

This disclosure relates to the determination of the positioning of at least one earpiece of a personal acoustic device relative to an ear of a user. In addition, the disclosure relates to the control of an operation of the personal acoustic device in response to the determination of the positioning.

SUMMARY

In one aspect, a method of controlling a personal acoustic device includes performing a first analyzing of at least one of an inner signal output by an inner microphone disposed within a cavity of a casing of an earpiece of a personal acoustic device and an outer signal output by an outer microphone disposed on the personal acoustic device so as to be acoustically coupled to an environment external to the casing of the earpiece to determine if a buffet event has occurred. A second analyzing of at least one of the inner signal and the outer signal is performed to determine if a voice event of a user of the personal acoustic device has occurred. In response to determining that a buffet event has occurred and that a voice event of a user of the personal acoustic device has not occurred, a third analyzing of the inner signal and the outer signal is performed. An operating state of the personal acoustic device is determined based on the third analyzing of the inner signal and the outer signal. The operating state includes a first state in which the earpiece is positioned in the vicinity of an ear and a second state in which the earpiece is absent from the vicinity of the ear.

Examples may include one or more of the following features:

The method may include initiating an operation at the personal acoustic device or a device in communication with the personal acoustic device when the determining of the operating state of the personal acoustic device indicates a change in the operating state. Initiating the operation may include at least one of: changing a power state, changing an active noise reduction state and changing an audio output state of the personal acoustic device or a device in communication with the personal acoustic device.

Performing the third analyzing may include performing a classification analysis to determine the operating state of the earpiece. The classification analysis may include a dimensionality reduction analysis. The dimensionality reduction analysis may include one of a principal component analysis, a linear discriminant analysis, a neural network analysis, a Fisher discriminant analysis and a quadratic discriminant analysis.

Performing the third analyzing may include calculating a ratio of a frequency response of the outer signal to the inner signal over a plurality of frequency ranges. Each ratio of frequency responses may be multiplied by a predetermined weight to produce a plurality of weighted ratios that are summed to produce a state value indicative of the operating state of the personal acoustic device. The state value may be compared to a first predetermined threshold to determine if the personal acoustic device is in the first state or the second state. The state value may be compared to a second predetermined threshold to determine if the personal acoustic device is in a third state in which the personal acoustic device is worn by the user and the earpiece is absent from the vicinity of the ear.

The operating state may include a third state in which the personal acoustic device is worn by the user and the earpiece is absent from the vicinity of the ear.

The first analyzing may include comparing at least one of: a power spectral density of the inner signal in a first frequency range and a power spectral density of the outer signal in the first frequency range to a predetermined threshold. The first frequency range may include frequencies below approximately 10 Hz.

The second analyzing may include comparing at least one of: an energy level of the inner signal in a first frequency range and an energy level of the outer signal in the first frequency range to a predetermined threshold. The first frequency range may include frequencies ranging from approximately 150 Hz to approximately 1.5 KHz.

In accordance with another aspect, a personal acoustic device includes an earpiece, an inner microphone, an outer microphone and a control circuit. The earpiece has a casing. The inner microphone is disposed within a cavity of the casing and outputs an inner signal representative of sound detected by the inner microphone. The outer microphone is disposed on the casing so as to be acoustically coupled to an environment external to the casing. The outer microphone outputs an outer signal representative of sound detected by the outer microphone. The control circuit is in communication with the inner microphone to receive the inner signal and is in communication with the outer microphone to receive the outer signal. The control circuit is configured to perform a first analysis of at least one of the inner signal and the outer signal to determine if a buffet event has occurred and to perform a second analysis of at least one of the inner signal and the outer signal to determine if a voice event of a user of the personal acoustic device has occurred. The control circuit is further configured to perform a third analysis of the inner signal and the outer signal in response to determining that a buffet event has a occurred and that a voice event of a user of the personal acoustic device has not occurred. The third analysis is performed to determine an operating state of the personal acoustic device. The operating state includes a first state in which the earpiece is positioned in the vicinity of an ear and a second state in which the earpiece is absent from the vicinity of the ear.

Examples may include one or more of the following features:

The control circuit may include a digital signal processor.

The personal acoustic device may include a power source in communication with the control circuit and the control circuit may be further configured to change a power state of the personal acoustic device when the determining of the operating state of the earpiece indicates a change in the operating state of the earpiece. The control circuit may be configured to reduce a power supplied by the power supply in response to a determination that the operating state of the personal acoustic device is the second state. The control circuit may be configured to increase a power supplied by the power supply in response to a determination that the operating state of the personal acoustic device has changed from the second state to the first state.

The inner microphone may be a feedback microphone in an acoustic noise reduction circuit. The outer microphone may be a feedforward microphone in an acoustic noise reduction circuit.

The control circuit may be disposed in the casing of the earpiece. The personal acoustic device may include a housing that is separate from the earpiece wherein the control circuit is disposed in the housing.

The control circuit may be configured to change an acoustic noise reduction operation in response to a determination that the operating state of the personal acoustic device has changed between the first and second operating states.

The personal acoustic device may further include a device in communication with the control circuit and wherein the control circuit is configured to control an operation of the device in response to a determination that the operating state of the personal acoustic device has changed between the first and second operating states.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
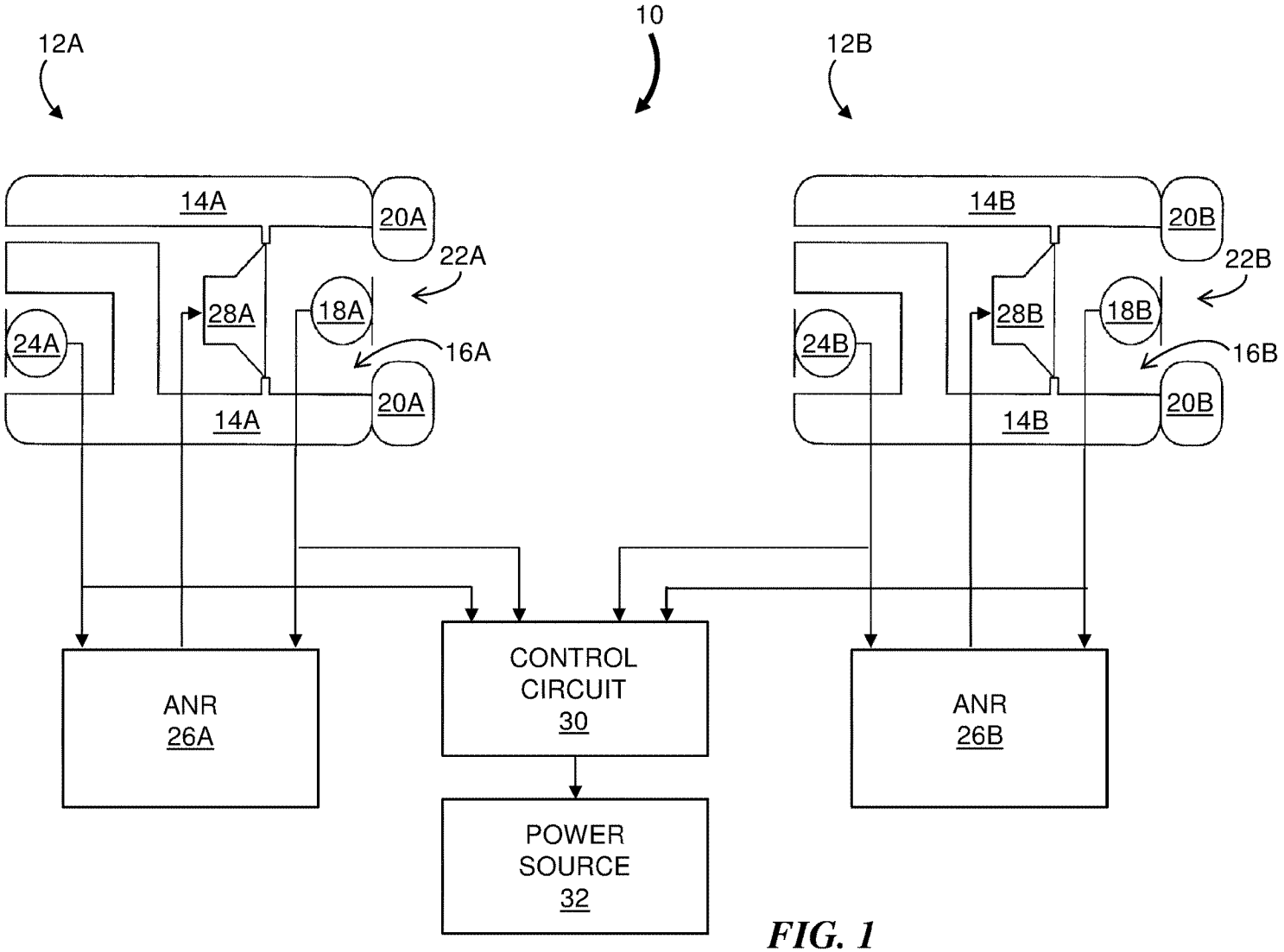
FIG. 1 is a block diagram of an example of a personal acoustic device that can determine an on head or off head operating state according to the positioning of at least one earpiece.

It has become commonplace for those who either listen to electronically provided audio (e.g., audio from an audio source such as a mobile phone, tablet, computer, CD player, radio or MP3 player), those who simply seek to be acoustically isolated from unwanted or possibly harmful sounds in a given environment and those engaging in two-way communications to employ personal acoustic devices (i.e., devices structured to be positioned in, over or around at least one of a user's ears) to perform these functions. For those who employ headphones or headset forms of personal acoustic devices to listen to electronically provided audio, it is commonplace for that audio to be provided with at least two audio channels (e.g., stereo audio with left and right channels) to be separately acoustically output with separate earpieces to each ear. Further, developments in digital signal processing (DSP) technology have enabled such provision of audio with various forms of surround sound involving multiple audio channels. For those simply seeking to be acoustically isolated from unwanted or possibly harmful sounds, it has become commonplace for acoustic isolation to be achieved through the use of active noise reduction (ANR) techniques based on the acoustic output of anti-noise sounds in addition to passive noise reduction (PNR) techniques based on sound absorbing and/or reflecting materials. Further, it is commonplace to combine ANR with other audio functions in headphones, headsets, earphones, earbuds and wireless headsets (also known as "earsets").

Despite these advances, issues of user safety and ease of use of many personal acoustic devices remain unresolved. More specifically, controls (e.g., a power switch) mounted on or otherwise connected to a personal acoustic device that are normally operated by a user upon either positioning the personal acoustic device in, over or around one or both ears or removing it therefrom are often undesirably cumbersome to use. The cumbersome nature of the controls often arises from the need to minimize the size and weight of such devices by minimizing the physical size of the controls. Also, controls of other devices with which a personal acoustic device interacts are often inconveniently located relative to the personal acoustic device and/or a user. Further, regardless of whether such controls are in some way carried by the personal acoustic device or by another device with which the personal acoustic device interacts, it is commonplace for users to forget to operate these controls when they position the acoustic device in, over or around one or both ears or remove it therefrom.

Various enhancements in safety and/or ease of use may be realized through the provision of an automated ability to determine the positioning of an earpiece of a personal acoustic device relative to a user's ear. The positioning of an earpiece in, over or around a user's ear, or in the vicinity of a user's ear, may be referred to below as an "on head" operating state. Conversely, the positioning of an earpiece so that it is absent from a user's ear, or not in the vicinity of a user's ear, may be referred to below as an "off head" operating state.

Various methods have been developed for determining the operating state of an earpiece as being on head or off head. Knowledge of a change in the operating state from on head to off head, or from off head to on head, can be applied for different purposes. For example, upon determining that at least one of the earpieces of a personal acoustic device has been removed from a user's ear to become off head, power supplied to the device may be reduced or terminated. Power control executed in this manner can result in longer durations between charging of one or more batteries used to power the device and can increase battery lifetime. Optionally, a determination that one or more earpieces have been returned to the user's ear can be used to resume or increase the power supplied to the device.

FIG. 1 is a block diagram of an example of a personal acoustic device 10 having two earpieces 12A and 12B, each configured to direct sound towards an ear of a user. Reference numbers appended with an "A" or a "B" indicate a correspondence of the identified feature with a particular one of the earpieces 12 (e.g., a left earpiece 12A and a right earpiece 12B). Each earpiece 12 includes a casing 14 that defines a cavity 16 in which at least one inner microphone 18 is disposed. An ear coupling 20 (e.g., an ear tip or ear cushion) attached to the casing 16 surrounds an opening to the cavity 16. A passage 22 is formed through the ear coupling 20 and communicates with the opening to the cavity 16. In some implementations, a substantially acoustically transparent screen or grill (not shown) is provided in or near the passage 22 to obscure the inner microphone 18 from view or to prevent damage to the inner microphone 18. An outer microphone 24 is disposed on the casing in a manner that permits acoustic coupling to the environment external to the casing. In some implementations, the inner microphone 18 is a feedback microphone and the outer microphone 24 is a feedforward microphone.

Each earphone 12 includes an ANR circuit 26 that is in communication with the inner and outer microphones 18 and 24. The ANR circuit 26 receives an inner signal generated by the inner microphone 18 and an outer signal generated by the outer microphone 24, and performs an ANR process for the corresponding earpiece 12. The process includes providing a signal to an electroacoustic transducer (e.g., speaker) 28 disposed in the cavity 16 to generate an anti-noise acoustic signal that reduces or substantially prevents sound from one or more acoustic noise sources that are external to the earphone 12 from being heard by the user.

A control circuit 30 is in communication with the inner and outer microphones 18 and 24 of each earpiece 12, and receives the inner signals and outer signals. In certain examples, the control circuit 30 includes a microcontroller or processor having a digital signal processor (DSP) and the inner and outer signals from the microphones 18 and 24 are converted to digital format by analog to digital converters. In response to the received inner and outer signals, the control circuit 30 generates one or more signals which can be used for a variety of purposes, including controlling various features of the personal acoustic device 10. As illustrated, the control circuit 30 generates a signal that is used to control a power source 32 for the device 10. The control circuit 30 and power source 32 may be in one or both of the earpieces 12 or may be in a separate housing in communication with the earpieces 12.

When an earpiece 12 is positioned on head, the ear coupling 20 engages portions of the ear and/or portions of the user's head adjacent to the ear, and the passage 22 is positioned to face the entrance to the ear canal of the ear. As a result, the cavity 16 and the passage 22 are acoustically coupled to the ear canal. At least some degree of acoustic seal is formed between the ear coupling 20 and the portions of the ear and/or the head of the user that the ear coupling 20 engages. This acoustic seal at least partially acoustically isolates the now acoustically coupled cavity 16, passage 22 and ear canal from the environment external to the casing 14 and the user's head. This enables the casing 14, the ear coupling 20 and portions of the ear and/or the user's head to cooperate to provide some degree of PNR. Consequently, sound emitted from external acoustic noise sources is attenuated to at least some degree before reaching the cavity 16, the passage 22 and the ear canal.

When the earpiece 12 is removed from the user's ear user so that it is off head and the ear coupling 20 is no longer engaged by portions of that ear and/or of the user's head, both the cavity 16 and the passage 22 are acoustically coupled to the environment external to the casing 14. This reduces the ability of the earpiece 12 to provide PNR and therefore sound emitted from external acoustic noise sources is allowed to reach the cavity 16 and the passage 22 with less attenuation. The recessed nature of the cavity 16 may continue to provide at least some degree of attenuation (in one or more frequency ranges) for sound from acoustic noise sources from entering into the cavity 16, but the degree of attenuation is still less than when the earpiece 12 is properly positioned on head.

As the earpiece 12 changes operating states between on head and off head, the inner signal from the inner microphone 18 within the cavity 16 is indicative of the resulting differences in attenuation as the inner microphone 18 detects sound propagating from the acoustic noise sources. Further, the outer microphone 24 can detect the same sound from the acoustic noise sources without the change in attenuation experienced by the inner microphone 18. Therefore, the outer microphone 24 is able to provide a reference signal representing the same sound substantially unchanged by changes in the operating state.

The control circuit 30 receives the inner and outer signals, and employs one or more techniques to examine differences between at least these signals to determine whether the earpiece 12 is in an on head or off head operating state. The determination of the operating state of the earpiece 12 enables the control circuit 30 to further determine if a change in the operating state has occurred. Various actions may be taken by the control circuit 30 in response to determining that a change in the operating state of the earpiece 12 has occurred. For example, the power supplied to the personal acoustic device 10 may be reduced upon a determination that one earpiece 12 (or both earpieces 12) is off head. In another example, full power may be returned to the device 10 in response to a determination that at least one earpiece 12 becomes on head. Other aspects of the personal acoustic device 10 may be modified or controlled in response to determining that a change in the operating state of the earpiece 12 has occurred. For example and without limitation, ANR functionality may be enabled or disabled, audio may be paused or played, a notification to a wearer may be altered, and a device in communication with the personal acoustic device may be controlled. Other examples of operational modes that may be performed by the system in response to detecting a change in position are described in U.S. application Ser. No. 15/088,020, the disclosure of which is incorporated herein by reference in its entirety.

Certain methods for determining the operating state for a personal acoustic device having ANR capability by analyzing the inner and/or outer signals are described, for example, in U.S. Pat. No. 8,238,567, "Personal Acoustic Device Position Determination," and U.S. Pat. No. 8,699,719, "Personal Acoustic Device Position Determination," the disclosures of which are incorporated herein by reference in their entirety. The methods are applicable to a personal acoustic device having a single earpiece or a personal acoustic device having two earpieces as shown in FIG. 1. The inner microphone 18 is typically used in ANR feedback circuitry while the outer microphone 24 which is exposed to the external acoustic environment is typically used in ANR feedforward circuitry. These methods determine the operating state as being in at least one of a first state in which the cavity 16 is acoustically coupled to the ear canal of the user (on head) and a second state in which the cavity 16 is not acoustically coupled to the ear canal (off head).

Errors can occur in the determination of the operating state. For example, a false determination that an earpiece was removed from the user's ear, or returned to the user's ear, can result from the analysis of the signals generated by the inner and outer microphones 18 and 24. The false determination may be due to an acoustic disturbance caused by bone conduction of vibration due to the user's speech. Similarly, a loud external noise may result in a false determination. These false determinations can lead to an unwanted change in the power state of the personal acoustic device and/or a change to the operating mode of the device. By way of example, operating modes can include audio playback, communications mode and ANR mode, and modes are not necessarily exclusive of each other. Changes in the power state and/or operating mode can result in annoyance and inconvenience to the user.

In various examples described below, a determination as to whether an earpiece of a personal acoustic device is on head or off head is made only if it is determined that a buffet event has occurred and that a voice event (e.g., speech) of the user has not occurred. Thus the process of determining the operating state of the earpiece is not continuously performed. In this manner, the opportunity for a false determination regarding the operating state of an earpiece is substantially diminished and unwanted changes in the power state and/or operating mode of the device are correspondingly reduced.

As used herein, a buffet event means an event that causes a physical vibration of an earpiece which results in a low frequency acoustic pulse (i.e., pressure spike) inside the earpiece while it is in, over or around the ear. The acoustic pulse typically has energy primarily at frequencies below approximately 10 Hz and can be detected by the inner microphone but not the outer microphone. Detection of this acoustic pulse is useful in determining the operating state of the earpiece as a buffet event typically happens during donning/doffing events (i.e. when a user is putting on or taking off the personal acoustic device); however, the acoustic pulse can also be generated by a loud external noise such as an explosion or a door slam. Additionally, vibration due to the voice of a user can be conducted through the body (e.g., bone conduction) so that the earpiece can vibrate and experience a buffet event. Thus a buffet event is not always a result of a change in the operating state of the earpiece.

As used herein, a voice event means that speech of the user has been detected. In one example, the determination of a voice event may be based on the spectral energy density in a range of frequencies from about 150 Hz to about 1.5 KHz. In other examples, the frequency range may extend to greater frequencies that may exceed several KHz. A voice event may be detected by the inner microphone, outer microphone, or a combination thereof.

Figure 2:
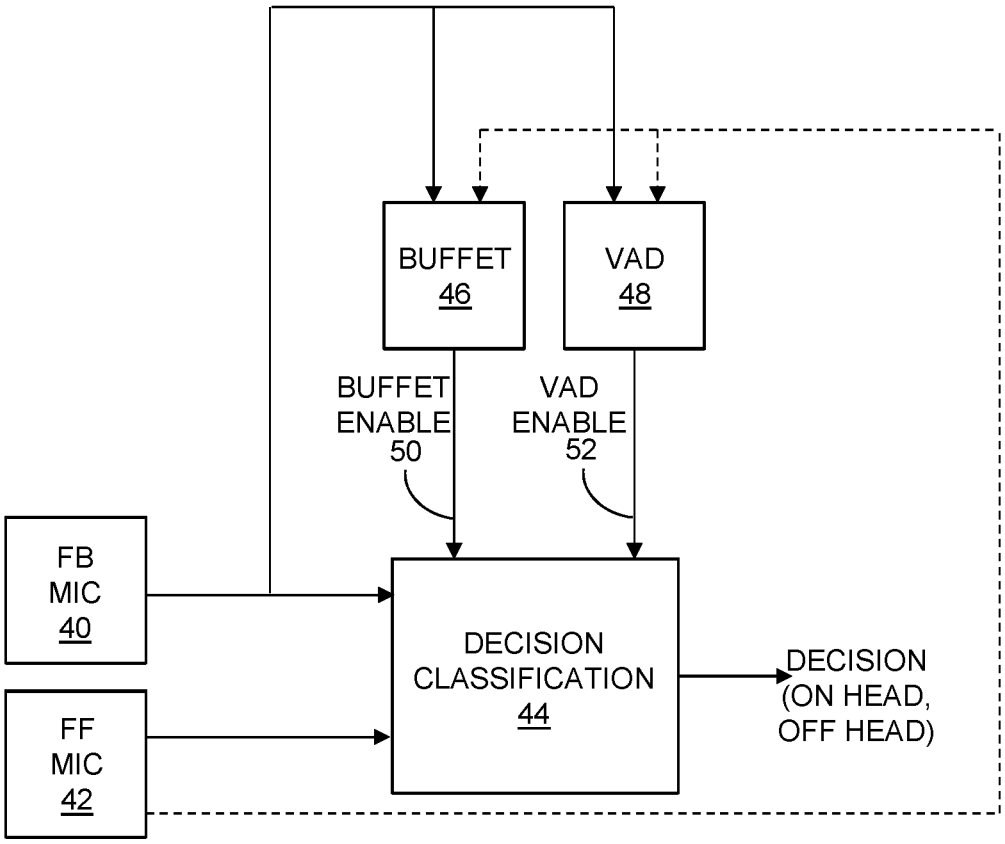
FIG. 2 is a functional block diagram depicting an example of how a determination of the operating state of an earpiece is made.

FIG. 2 is a functional block diagram depicting how a determination (i.e., decision) is made as to the operating state of an earpiece. For example, the earpiece can be one of the earpieces 12 in the personal acoustic device 10 shown in FIG. 1. A feedback (inner) microphone 40 and a feedforward (outer) microphone 42 generate an inner signal and an outer signal, respectively, which are provided to a decision classification module 44 which performs a classification analysis. The inner signal is also provided to a buffet module 46 and a voice activity detection (VAD) module 48. In some examples (not shown), the outer signal may also be provided to the VAD module 48. If the buffet module 46 determines that a buffet event has occurred, a buffet flag 50 is asserted. If the VAD module 48 determines that a voice event has occurred, a VAD flag 52 is disabled, otherwise the VAD module 48 asserts the VAD flag 52. Although the buffet module 46 and the VAD module 48 are each capable of modulating the decision classification analysis, the decision classification module 44 will start execution of the classification analysis only if both the buffet flag 50 and VAD flag 52 are simultaneously asserted, indicating that a buffet event has been determined and that no speech event has been determined. The classification analysis then examines the inner and outer signals only for a predetermined time (e.g., 5 seconds) after both the buffet and VAD flags 50 and 52 first became simultaneously asserted to come to a determination as to the operating state of the earpiece. The classification analysis may utilize narrow band sampling (e.g., 4 KHz resolution) available in the frequency domain. The result of the classification analysis is maintained until the next time that both the buffet flag 50 and the VAD flag 52 are simultaneously asserted. The limited duration window for analysis prevents false determinations of a change of state that might otherwise occur if the classification analysis were allowed to operate longer or in a continuous mode. The window also provides for a reduction in battery and computation power.

The decision classification module 44, buffet module 46 and VAD module 48 may be implemented, for example, in the control circuit 30 of FIG. 1. The control circuit 30 may include one or more processors and/or microcontrollers that enable the functionality of the modules 44, 46 and 48.

Figure 3:
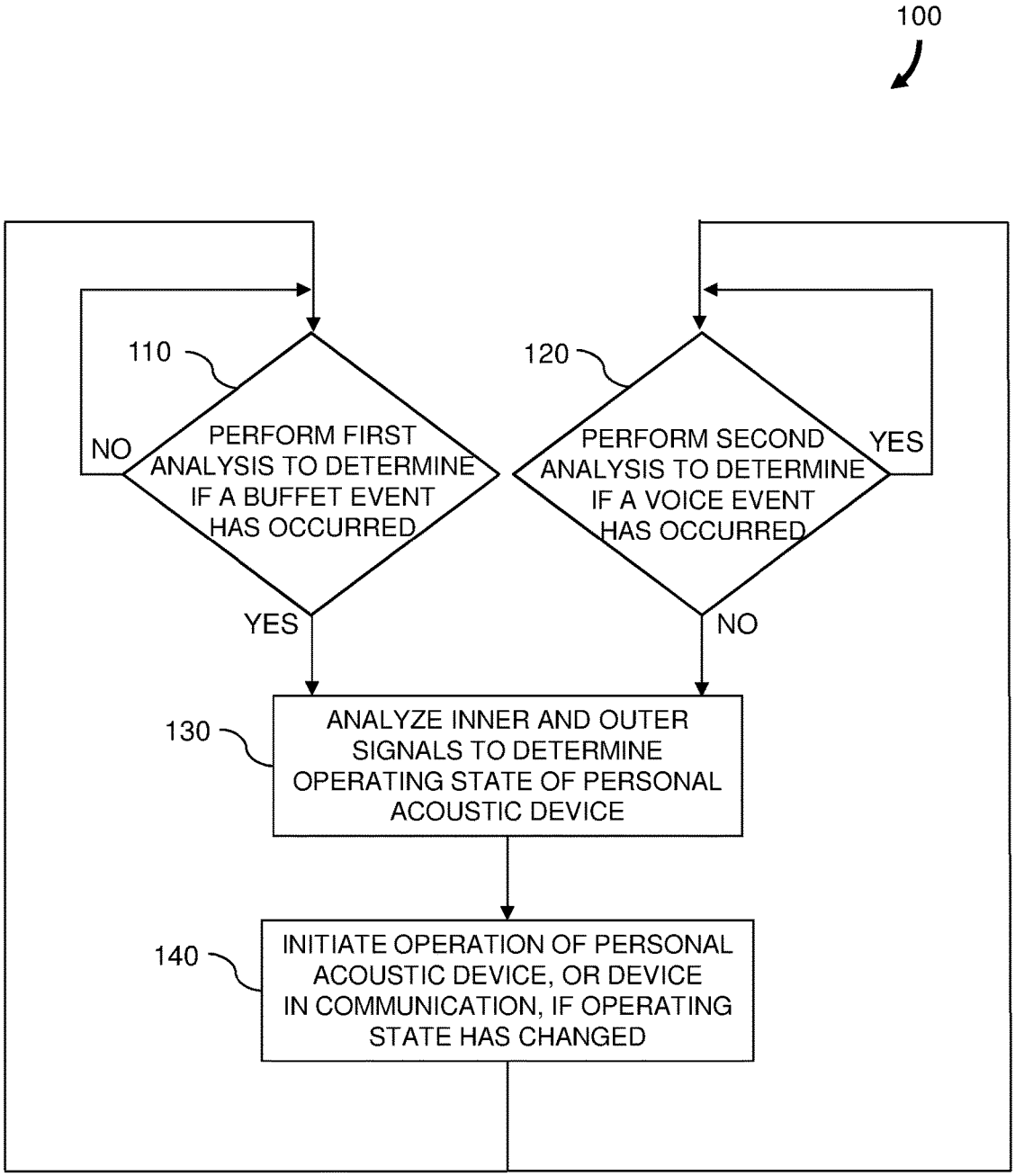
FIG. 3 is a flowchart representation of an example of a method of controlling a personal acoustic device.

FIG. 3 is a flowchart representation of an example of a method 100 of controlling a personal acoustic device. According to the method 100, a first analysis of at least one of the inner signal output by an inner microphone and an outer signal output by an outer microphone disposed on the personal acoustic device is performed (110) to determine if a buffet event has occurred. For example, the first analysis may include comparing at least one of an energy level and/or power spectral density of the inner signal in a frequency range (e.g., frequencies below approximately 10 Hz) and an energy level and/or power spectral density of the outer signal in the frequency range to a predetermined threshold. A second analysis of at least one of the inner signal and the outer signal is performed (120) to determine if a voice event of the user of the device has occurred. For example, the second analysis may include comparing at least one of an energy level and/or power spectral density of the inner signal in a frequency range (e.g., frequencies between approximately 150 Hz and 1.5 KHz) and an energy level and/or power spectral density of the outer signal in the frequency range to a predetermined threshold.

If a buffet event is determined to have occurred and a voice event is determined not to have occurred, a third analysis is performed (130) on the inner and outer signals to determine an operating state of the personal acoustic device. The operating state can be one of a first state in which the earpiece is positioned in, over or around an ear (on head) and a second state in which the earpiece is absent from the ear (off head). If the determination of the operating state of the device indicates a change in the operating state, an operation of the personal acoustic device may be initiated (140). By way of examples, initiating an operation of the device includes changing a power state, changing an ANR state and changing an audio output state of the device or a different device in communication with the personal audio device. In one implementation there are two active power modes for the device. The first power mode permits music playback and/or ANR where substantial power is consumed by the device and the second power mode is a low power mode (e.g., 10% of the first power mode) in which the capabilities of determining buffet and voice events are maintained. In this implementation changes in the operating state can be used to change between the first and second power states.

In various examples described above, the determination of the operating state of a single earpiece has been described; however, it will be recognized that a determination of the operating state of each of two earpieces in a personal audio device can be made and the results of the two determinations made be used to control the personal acoustic device. For example, if it is determined that a change in the operating state occurred for only one earpiece, an operation of the device may be initiated that is different from an operation that may be initiated upon a determination that a change in the operating state occur for both earpieces.

The determination as to which operating state the earpiece is in, that is, whether an earpiece of a personal acoustic device is either on head or off head, can be based on any of a number of determination schemes that may be executed in the control circuit 30 shown in FIG. 1. A dimension reduction algorithm can be performed to aid the determination. A supervised learning algorithm may be trained with labeled data sets, as is known in the art, and may utilize data from the inner and outer signals according to a ratio of the power densities and/or frequency responses of the inner and outer signals in a number of frequency bins. Weighting factors for each frequency bin can be learned to improve or maximize the separations between the states, and a sum of weighted ratios may be calculated to produce a state value indicative of the operating state of the device. The state value may be compared to a predetermined threshold to determine (i.e., make a decision) as to whether the operating state is on head or off head.

By way of example, a principal component analysis (PCA) can be performed for classification. Alternatively, a linear discriminant analysis (LDA) may be used. Other classification algorithms known in the art can be used such as a Fisher discriminant analysis, a quadratic discriminant analysis (QDA) or neural networks.

In some examples, the supervised learning using real data sets is used so that more than two operating states can be determined. For example, the operating states can include a first state in which the earpiece of the personal acoustic device is on head, a second state in which the earpiece is off head and not worn by the user, and a third state in which the earpiece is off head and worn ("parked") on or about the body of the user.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. A method of controlling a personal acoustic device comprising:

performing a first analyzing of an inner signal output by an inner microphone disposed within a cavity of a casing of an earpiece of a personal acoustic device and an outer signal output by an outer microphone disposed on the personal acoustic device so as to be acoustically coupled to an environment external to the casing of the earpiece to determine if a buffet event has occurred;

performing a second analyzing of at least one of: the inner signal and the outer signal to determine if a voice event of a user of the personal acoustic device has occurred;

in response to determining that a buffet event has occurred and that a voice event of a user of the personal acoustic device has not occurred, performing a third analyzing of the inner signal and the outer signal; and determining an operating state of the personal acoustic device based on the third analyzing of the inner signal and the outer signal, the operating state comprising a first state in which the earpiece is positioned in the vicinity of an ear and a second state in which the earpiece is absent from the vicinity of the ear.

2. The method of claim 1 further comprising initiating an operation at the personal acoustic device or a device in communication with the personal acoustic device when the determining of the operating state of the personal acoustic device indicates a change in the operating state.

3. The method of claim 2, wherein initiating the operation comprises at least one of: changing a power state, changing an active noise reduction state and changing an audio output state of the personal acoustic device or a device in communication with the personal acoustic device.

4. The method of claim 1 wherein performing the third analyzing comprises performing a classification analysis to determine the operating state of the earpiece.

5. The method of claim 4 wherein the classification analysis comprises a dimensionality reduction analysis.

6. The method of claim 5 wherein the dimensionality reduction analysis comprises one of a principal component analysis, a linear discriminant analysis, a neural network analysis, a Fisher discriminant analysis and a quadratic discriminant analysis.

7. The method of claim 1 wherein performing the third analyzing comprises calculating a ratio of a frequency response of the outer signal to the inner signal over a plurality of frequency ranges.

8. The method of claim 7 wherein performing the third analyzing further comprises multiplying each ratio of frequency responses by a predetermined weight to produce a plurality of weighted ratios and summing the weighted ratios to produce a state value indicative of the operating state of the personal acoustic device.

9. The method of claim 8 wherein performing the third analyzing further comprises comparing the state value to a first predetermined threshold to determine if the personal acoustic device is in the first state or the second state.

10. The method of claim 9 wherein performing the third analyzing further comprises comparing the state value to a second predetermined threshold to determine if the personal acoustic device is in a third state in which the personal acoustic device is worn by the user and the earpiece is absent from the vicinity of the ear.

11. The method of claim 1 wherein the operating state further comprises a third state in which the personal acoustic device is worn by the user and the earpiece is absent from the vicinity of the ear.

12. The method of claim 1 wherein the first analyzing comprises comparing at least one of: a power spectral density of the inner signal in a first frequency range and a power spectral density of the outer signal in the first frequency range to a predetermined threshold.

13. The method of claim 12 wherein the first frequency range comprises frequencies below approximately 10 Hz.

14. The method of claim 1 wherein the second analyzing comprises comparing at least one of: an energy level of the inner signal in a first frequency range and an energy level of the outer signal in the first frequency range to a predetermined threshold.

15. The method of claim 14, wherein the first frequency range comprises frequencies ranging from approximately 150 Hz to approximately 1.5 KHz.

16. A personal acoustic device comprising:

an earpiece having a casing;

an inner microphone disposed within a cavity of the casing and outputting an inner signal representative of sound detected by the inner microphone;

an outer microphone disposed on the casing so as to be acoustically coupled to an environment external to the casing and outputting an outer signal representative of sound detected by the outer microphone; and a control circuit in communication with the inner microphone to receive the inner signal and in communication with the outer microphone to receive the outer signal, the control circuit configured to:

perform a first analysis of the inner signal and the outer signal to determine if a buffet event has occurred;

perform a second analysis of at least one of: the inner signal and the outer signal to determine if a voice event of a user of the personal acoustic device has occurred; and in response to determining that a buffet event has a occurred and that a voice event of a user of the personal acoustic device has not occurred, perform a third analysis of the inner signal and the outer signal to determine an operating state of the personal acoustic device, the operating state comprising a first state in which the earpiece is positioned in the vicinity of an ear and a second state in which the earpiece is absent from the vicinity of the ear.

17. The personal acoustic device of claim 16 wherein the control circuit comprises a digital signal processor.

18. The personal acoustic device of claim 16 further comprising a power source in communication with the control circuit and wherein the control circuit is further configured to change a power state of the personal acoustic device when the determining of the operating state of the earpiece indicates a change in the operating state of the earpiece.

19. The personal acoustic device of claim 18 wherein the control circuit is configured to reduce a power supplied by the power supply in response to a determination that the operating state of the personal acoustic device is the second state.

20. The personal acoustic device of claim 18 wherein the control circuit is configured to increase a power supplied by the power supply in response to a determination that the operating state of the personal acoustic device has changed from the second state to the first state.

21. The personal acoustic device of claim 16 wherein the inner microphone is a feedback microphone in an acoustic noise reduction circuit.

22. The personal acoustic device of claim 16 wherein the outer microphone is a feedforward microphone in an acoustic noise reduction circuit.

23. The personal acoustic device of claim 16 wherein the control circuit is disposed in the casing of the earpiece.

24. The personal acoustic device of claim 16 further comprising a housing that is separate from the earpiece and wherein the control circuit is disposed in the housing.

25. The personal acoustic device of claim 16 wherein the control circuit is configured to change an acoustic noise reduction operation in response to a determination that the operating state of the personal acoustic device has changed between the first and second operating states.

26. The personal acoustic device of claim 16 further comprising a device in communication with the control circuit and wherein the control circuit is configured to control an operation of the device in response to a determination that the operating state of the personal acoustic device has changed between the first and second operating states.

* * * * *